United States Patent [19]

Kobzan

[11] 4,140,112

[45] Feb. 20, 1979

[54] DIVING REGULATOR

[75] Inventor: John Kobzan, Glenview, Ill.

[73] Assignee: Dacor Corporation, Northfield, Ill.

[21] Appl. No.: 797,198

[22] Filed: May 16, 1977

[51] Int. Cl.[2] ..... B63C 11/16

[52] U.S. Cl. ..... 128/142.2; 137/494; 137/DIG. 9

[58] Field of Search ..... 128/142.2, 142 R, 210, 128/209, 147; 137/DIG. 9, DIG. 8, 494, 599

[56] References Cited

U.S. PATENT DOCUMENTS 3,633,611 1/1972 MacNiel ..... 137/DIG. 9

FOREIGN PATENT DOCUMENTS 935911 9/1963 United Kingdom ..... 137/DIG. 9

*Primary Examiner*—Henry J. Recla

*Attorney, Agent, or Firm*—Edmond T. Patnaude

[57] ABSTRACT

An imperforate clip is slidable on the air inlet housing in a diving regulator for movement over one of a plurality of valve outlet ports to adjust the ratio of the air flow into the breathing chamber to the air flow directly into the mouthpiece.

2 Claims, 4 Drawing Figures

DIVING REGULATOR

The present invention relates in general to regulators of the type used in underwater breathing apparatus, and it relates in particular to a new and improved regulator incorporating novel means for adjusting the venturi action provided in the regulator.

BACKGROUND OF THE INVENTION

In order to reduce the inhalation effort required to hold open the air inlet valve of a demand type diving regulator it is common practice to cause some of the air from the inlet valve to flow through the breathing chamber directly into the breathing port or mouthpiece tube. This air flow educts air from the breathing chamber whereby the pressure in the breathing chamber remains below ambient pressure. Since the inlet valve opens in response to such a reduced pressure in the breathing chamber, it remains open without any heavy inhalation by the user. In addition to this so-called venturi port, the air inlet also includes one or more additional ports which are remote from the venturi port and which supply air to the breathing chamber.

SUMMARY OF THE INVENTION

Briefly, in accordance with the present invention means are incorporated in a demand type diving regulator for adjusting the ratio of the air flowing from the air inlet valve directly into the breathing port or mouthpiece tube to the air from the air inlet valve flowing into the breathing chamber. In a preferred embodiment of the invention the adjustment means comprises an imperforate clip slidably mounted on the air inlet valve housing so as to be adjustably positioned over one or more of the air inlet ports to adjust the venturi action in the regulator.

GENERAL DESCRIPTION OF THE DRAWING

Further advantages and a better understanding of the present invention may be had from a reference to the accompanying drawing wherein.

DETAILED DESCRIPTION OF THE INVENTION

Figure 1:
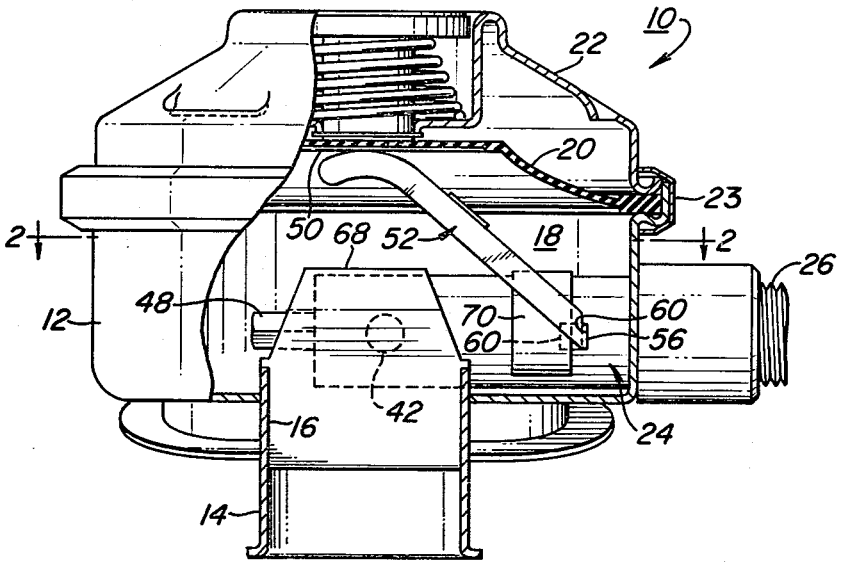
FIG. 1 is a side view, partly in cross-section, of a demand type diving regulator embodying the present invention.
Figure 2:
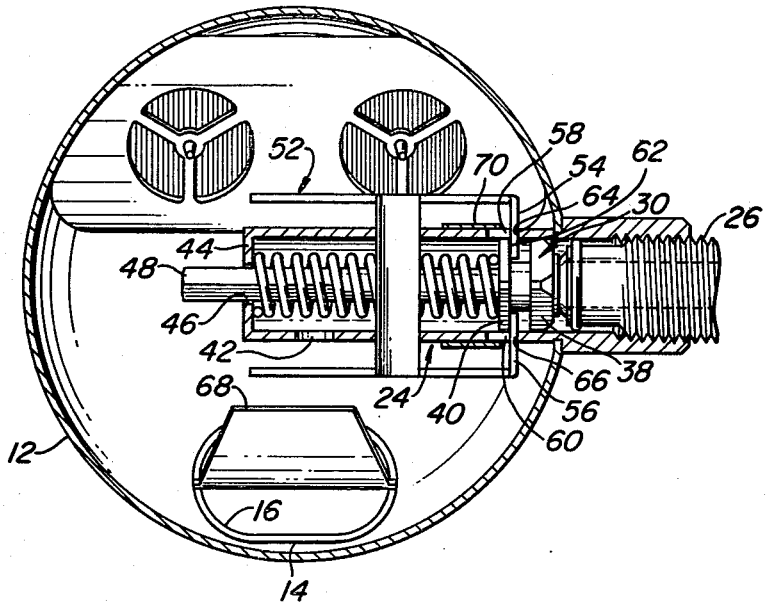
FIG. 2 is a cross-sectional view taken along the line 2—2 of FIG. 1.

Referring in particular to FIGS. 1 and 2, a demand type diving regulator 10 of the type used in underwater breathing apparatus includes a cup-like housing member 12 having a mouthpiece tube 14 extending through the bottom wall thereof. The tube 14 thus defines a breathing port 16 opening into a breathing chamber 18 within the housing 12. A circular flexible diaphragm 20 is disposed across the upper open end of the housing 12, and an apertured cover 22 fits over the diaphragm. In order to seal the breathing chamber 18 from the ambient, the peripheral portion of the diaphragm is compressed between the housing 12 and the cover 22. A clamp 23 holds the cover 22 in sealed relationship with the housing 12.

Figure 3:
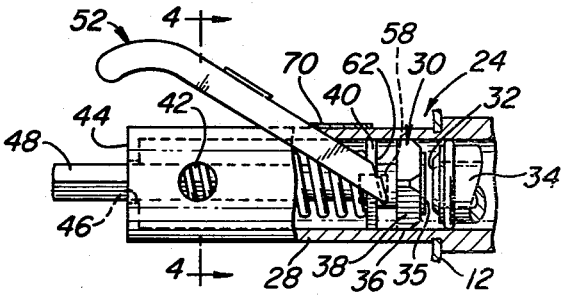
FIG. 3 is a side view, partly in cross-section, of the air inlet valve used in the regulator shown in FIGS. 1 and 2.
Figure 4:
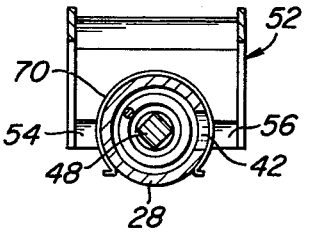
FIG. 4 is a sectional view taken along the line 4—4 of FIG. 3.

An air inlet valve 24 extends across a diameter of the housing 12 along the bottom wall thereof and includes an air inlet fitting 26 disposed externally of the housing 12 for connection of the valve 24 to a source of air under pressure. The valve 24 includes a tubular housing or body 28 having a valve member 30 axially slidable therein between a closed position against an annular valve seat 32 surrounding an axial opening or port in a tubular member 34 and an open position as shown in FIG. 3. A circular, resilient member 35 is carried at the end of the valve member 30 by the end portion 36 which is square in cross-section to provide a plurality of flats 38 past which the air flows when the port is open. A flange 40 is also square in cross-section to permit air to flow down the housing tube 28 to a venturi air outlet port 42 in the side of the housing tube opposite the breathing port 16. The housing tube 28 has an end wall 44 provided with a square hole 46 to slidably receive the stem portion 48 of the valve member 30. A coil spring is compressed between the end wall 44 and the flange 40 to bias the valve member into a closed position against the valve seat 32.

In order to open the air inlet valve 24 in response to inhalation by the diver, a valve actuating member 52 is connected between the bottom wall 50 of the diaphragm 20 and the valve element 30. When the pressure in the breathing chamber 18 falls below ambient pressure, the diaphragm 20 moves downwardly into the breathing chamber to pivot the actuating member in a counterclockwise direction. The lower ends 54 and 56 of the member 52 extend through mutually aligned openings 58 and 60 in the housing tube 18 into engagement with a surface 62 on the flange 40. As more fully described in U.S. Pat. No. 3,633,611 the ends 54 and 56 of the actuator are flat and when the air inlet valve is closed are pressed against the flat edges 64 and 66 of the openings 58 and 60.

The air which exits the valve 24 through the port 42 flows as a jet against a deflector 68 and thus directly into the breathing port 16. This jet of air flowing between the port 42 and the deflector 68 provides through a venturi action a low pressure area beneath the diaphragm thereby reducing the inhalation effort required to maintain the valve element in an open position. In the prior art, this venturi effect was adjusted by physically bending the inner end portion of the deflector 68 so as to deflect more or less of the jet of air from the port 42 into the breathing port 16.

In addition to the air flow out through the port 42, inlet air exits the inlet valve and enters the breathing chamber 18 through the openings 58 and 60 as well as through the space between the stem 48 and the opening 46 at the inner end of the housing tube 28. I have found that by reducing the combined areas of those openings which convey air into the breathing chamber, the venturi effect is increased. Accordingly, an imperforate spring clip 70 is mounted over the housing tube 28 for adjustable movement in an axial direction. As best shown in FIG. 2, the clip 70 is sufficiently long to cover portions of both of the openings 58 and 60. However, the clip can be rotated on the tube 28 so as to cover only one of these openings. Accordingly, a substantial degree of venturi adjustment can be made by adjusting the position of the spring clip 70 over the openings 58 and 60. When the clip 70 is in the position shown in FIG. 1, a maximum venturi effect is provided inasmuch as the ratio of the air exiting the port 42 to the air entering the breathing chamber through the other ports is at a maximum. If the clip 70 were moved to the left completely away from the openings 58 and 60 the venturi effect would be a minimum.

The clip 70 can be positioned directly over a portion of the venturi port 42 to reduce the venturi action. I have found, however, that a more precise tuning of the regulator can be achieved when the clip 70 is adjustably positioned over the openings 58 and 60.

While the present invention has been described in connection with particular embodiments thereof, it will be understood by those skilled in the art that many changes and modifications may be made without departing from the true spirit and scope of the present invention. Therefore, it is intended by the appended claims to cover all such changes and modifications which come within the true spirit and scope of this invention.

What is claimed:

1. In a diving regulator for use in under water breathing apparatus, the combination comprising a cup-like housing, a diaphragm mounted across said housing to provide a breathing chamber in said housing, a breathing port disposed in one wall of said housing, an air inlet valve having a valve housing positioned in said chamber and a valve member movable in said valve housing between a closed position said valve housing having an opening adjacent said valve member, and an open position, a valve actuator disposed in said chamber and having a valve member engaging portion extending through an opening in said valve housing into operative engagement with said valve member, said valve actuator having a diaphragm engaging portion, said air inlet valve having an outlet port positioned to cause air emitted thereby to flow as a stream directly into said breathing port to effect a Venturi action in said chamber, and a Venturi control means mounted on said valve housing for disposition over a selectable portion of said opening to adjust the amount of air entering said chamber through said opening when said air inlet valve is open.

2. In a diving regulator for use in breathing under water, the combination comprising a main housing, a diaphragm mounted across said housing to provide a breathing chamber in said housing, a breathing port disposed in a wall of said housing and opening into said chamber, an air inlet valve having a tubular housing positioned in said chamber and having an air outlet port therein positioned to cause air from said valve to flow as a stream into said breathing port to effect a Venturi action in said chamber, a valve member movably mounted in said tubular housing relative to a valve seat therein, a pair of mutually aligned openings in said tubular housing adjacent said valve member, a valve actuating lever having end portions extending through said mutually aligned openings in said tubular housing into operative engagement with said valve member, said aligned openings being on the downstream side of said valve seat, said valve actuating lever having a diaphragm engaging portion whereby movement of said diaphragm into said chamber opens said valve and movement of said diaphragm out of said chamber closes said valve, said mutually aligned openings being substantially longer in the longitudinal direction of said tubular housing than the corresponding dimensions of said end portions of said lever to provide air outlet passages from said air inlet valve to said breathing chamber, and clip means mounted on said tubular housing for adjustable movement over respective portions of said aligned openings for controllably restricting the flow of air through said openings into said breathing chamber to adjust the Venturi action of the regulator.

* * * * *

UNITED STATES PATENT AND TRADEMARK OFFICE

CERTIFICATE OF CORRECTION

PATENT NO. : 4,140,112

DATED : February 20, 1979

INVENTOR(S) : John Kobzan

It is certified that error appears in the above-identified patent and that said Letters Patent are hereby corrected as shown below:

Column 3, lines 27-29, the phrase "said valve housing having an opening adjacent said valve member," should be deleted and inserted at the end of line 29, following the comma (,).

Signed and Sealed this

*Twenty-second* Day of *May 1979*

[SEAL]

*Attest:*

RUTH C. MASON
*Attesting Officer*

DONALD W. BANNER
*Commissioner of Patents and Trademarks*